US011751650B2

(12) United States Patent
Ekdahl et al.

(10) Patent No.: US 11,751,650 B2
(45) Date of Patent: Sep. 12, 2023

(54) WHEELED BACKPACK WITH EXTENDABLE HANDLE

(71) Applicant: Klein Tools, Inc., Lincolnshire, IL (US)

(72) Inventors: Kevin A. Ekdahl, Lincolnshire, IL (US); Caleb Nielsen, Mundelein, IL (US)

(73) Assignee: Klein Tools, Inc., Lincolnshire, IL (US)

( * ) Notice: Subject to any disclaimer, the term of this patent is extended or adjusted under 35 U.S.C. 154(b) by 163 days.

(21) Appl. No.: 17/196,220

(22) Filed: Mar. 9, 2021

(65) Prior Publication Data

US 2022/0287424 A1 Sep. 15, 2022

(51) Int. Cl.

| | |
|---|---|
| ***A45C 5/14*** | (2006.01) |
| ***A45F 3/08*** | (2006.01) |
| ***A45C 13/26*** | (2006.01) |
| *A45F 3/00* | (2006.01) |

(52) U.S. Cl.

CPC ..... *A45C 5/146* (2013.01); *A45C 13/262* (2013.01); *A45F 3/08* (2013.01); *A45C 2013/267* (2013.01); *A45F 2003/001* (2013.01)

(58) Field of Classification Search

CPC ..... A45F 3/04; A45F 3/02; A45F 3/08; A45F 4/02; A45C 5/14; A45C 13/262; A45C 13/385; A45C 2013/267

See application file for complete search history.

(56) References Cited

U.S. PATENT DOCUMENTS

| | | | | |
|---|---|---|---|---|
| 6,530,507 | B2 * | 3/2003 | Oh | A45C 5/14 224/653 |
| 8,662,268 | B2 * | 3/2014 | Keir | A45C 13/04 190/122 |
| 2016/0270496 | A1 * | 9/2016 | Pitchforth | B62B 1/12 |
| 2017/0055658 | A1 * | 3/2017 | Yu | A45C 13/10 |
| 2020/0046094 | A1 * | 2/2020 | Chen | A45C 7/0086 |
| 2021/0235831 | A1 * | 8/2021 | Brouard | A45C 13/28 |

* cited by examiner

*Primary Examiner* — Corey N Skurdal

(57) ABSTRACT

A wheeled backpack includes a bottom frame member, a fabric bag portion, a pair of laterally spaced wheels, a pair of side frame members, and a telescoping handle that can move between a retracted position and an extended position where the handle can be grasped by a user to roll the backpack on the wheels. The handle is located so that there is little or no fore and aft offset of the center of mass/gravity of the backpack, which minimizes torquing on the handle and associated pivoting of the backpack in a user's hand when the backpack is lifted by the handle with the handle in the retracted position.

20 Claims, 12 Drawing Sheets

WHEELED BACKPACK WITH EXTENDABLE HANDLE

CROSS-REFERENCE TO RELATED APPLICATIONS

None

BACKGROUND OF THE DISCLOSURE

The present disclosure relates to rolling/wheeled backpacks having a telescoping handle. While many such backpacks are known, there is always room for improvements, including, for example, improvements in the ergonomics, the usability, and the structural support of such backpacks.

BRIEF SUMMARY OF THE DISCLOSURE

In accordance with one feature of this disclosure, a wheeled backpack includes a bottom frame member, a pair of laterally spaced side panels extending upwardly from the bottom frame member, a back panel extending between the side panels and extending upwardly from a back portion of the bottom frame member, a front panel extending between the side panels and extending upwardly from a front portion of the bottom frame member, a pair of laterally spaced wheels, a pair of side frame members connected to the bottom frame member and extending upwardly from the bottom frame member, a telescoping handle, and at least one shoulder strap overlying the back panel and having an upper part connected to at an upper region of the backpack and a lower part connected to a lower region of the backpack. Each of the wheels is mounted on the back portion of the bottom frame member for rotation about a laterally extending wheel axis. Each of the side frame members overlays an exterior surface of a corresponding one of the side panels and is located forward of the back panel and the wheel axes. The telescoping handle includes a grip and a pair of laterally spaced grip supports extending downwardly from the grip, with each grip support mounted to a corresponding one of the side frame members to translate vertically relative to the corresponding one of the side frame members between a retracted position and an extended position.

As one feature, at least some of the panels are fabric panels.

In one feature, all the panels are fabric panels.

According to one feature, the bottom frame member includes an upper rim and the panels are fixed to the upper rim.

In one feature, the upper part of the at least one shoulder strap is fixed to an upper area of the pack panel, and the lower part of the at least one shoulder strap is fixed to a lower area of the back panel.

As one feature, the at least one shoulder strap includes two shoulder straps.

According to one feature, the pair of side frame members are fixed to the bottom frame member.

As one feature, each of the grip supports includes a first support member slidably received within a second support member. As a further feature, each of the second support members is slidably received in the corresponding one of the side frame members.

In one feature, the grip supports are releasably locked in the retracted position. In a further feature, the wheeled backpack further includes a user actuated release member carried in the grip for movement between a lock position wherein the grip supports are locked in the retracted position and a release position wherein the grip supports are free to translate from the retracted position to the extended position.

According to one feature, the side frame members extend parallel to a plane defined by the back panel.

As one feature, the wheeled backpack further includes a zip closure releasably attaching a flap portion of the front panel to a remainder of the backpack.

In one feature, the wheel axes are aligned to define a single laterally extending axis, and the bottom frame member is a one-piece component.

In accordance with one feature of this disclosure, a wheeled backpack includes a bottom frame member, a fabric bag portion connected to the bottom frame member and extending upwardly from the bottom frame member, a pair of laterally spaced wheels, a pair of side frame members connected to the bottom frame member and extending upwardly from the bottom frame member, a telescoping handle, and at least one shoulder strap overlying the back face and having an upper part connected to an upper region of the backpack and a lower part connected to a lower region of the backpack. The bag portion includes a front face, a back face, and a pair of laterally spaced sides, each side extending between the front and back faces. Each wheel is mounted on the bottom frame member adjacent the back face for rotation about a laterally extending wheel axis. Each side frame member overlays an exterior surface of a corresponding one of the sides and is located forward of the back face and the wheel axes. The telescoping handle includes a grip and a pair of laterally spaced grip supports extending downwardly from the grip, with each grip support mounted to a corresponding one of the side frame members to translate vertically relative to the corresponding one of the side frame members between a retracted position and an extended position.

As one feature, the bottom frame member includes an upper rim and the fabric bag portion is fixed to the upper rim.

In one feature, the upper part of the at least one shoulder strap is fixed to an upper area of the fabric bag portion, and the lower part of the at least one shoulder strap is fixed to a lower area of the fabric bag portion.

According to one feature, the at least one shoulder strap includes two shoulder straps.

In one feature, the pair of side frame members are fixed to the bottom frame member.

As one feature, each of the grip supports includes a first support member slidably received within a second support member. In a further feature, each of the second support members is slidably received in the corresponding one of the side frame members.

According to one feature, the grip supports are releasably locked in the retracted position.

In one feature, the wheeled backpack further includes a user actuated release member carried in the grip for movement between a lock position wherein the grip supports are locked in the retracted position and a release position wherein the grip supports are free to translated from the retracted position to the extended position.

As one feature, the side frame members extend parallel to a plane defined by the back face.

According to one feature, the wheeled backpack further includes a zip closure releasably attaching a flap portion of the front panel to a remainder of the fabric bag portion.

In one feature, the wheel axes are aligned to define a single laterally extending axis, and the bottom frame member is a one-piece component.

It should be understood that the inventive concepts disclosed herein do not require each of the features discussed above, may include any combination of the features discussed, and may include features not specifically discussed above.

DETAILED DESCRIPTION OF PREFERRED EMBODIMENTS

Figure 1:
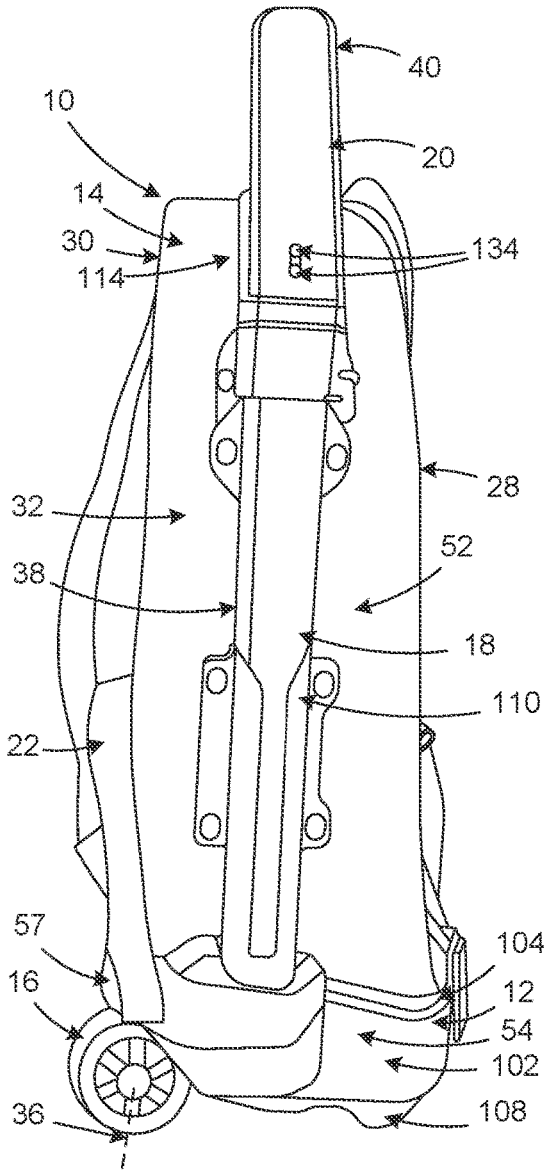
FIG. 1 is a view of the left side of a wheeled backpack according to this disclosure, with a telescoping handle shown in a retracted position.

As best seen in FIGS. 1-4, a wheeled backpack 10 includes a bottom frame member 12, a bag portion 14, a pair of laterally spaced wheels 16, a pair of side frame members 18, a telescoping handle 20, and a pair of shoulder straps 22. In the preferred and illustrated embodiment, the telescoping handle 20 can move between a retracted position shown in FIGS. 1, 3-6 and 8-10 and an extended position shown in FIG. 2. In the extended position, the handle 20 can be grasped by a user to roll the backpack 10 on the wheels 16 from one location to another. In the retracted position, the handle 20 can be grasped by a user to carry the backpack 10 from one location to another. In this regard, the handle 10 is preferably located so there is little or no fore and aft offset of the center of mass/gravity of the backpack relative to the handle 10 so as to minimize torquing on the handle 20 and associated pivoting of the backpack in a user's hand when the backpack 10 is lifted by the handle 20.

The bag portion 14 includes a front face 28, a back face 30, and a pair of laterally spaced sides 32, each side 32 extending between the front and back faces 28 and 30. In the illustrated and preferred embodiment, the bag portion 14 is a fabric bag portion 14 that is connected to the bottom frame member 10, extending upwardly from the bottom frame member 12.

Each of the laterally spaced wheels 16 is mounted on the bottom frame member 12 adjacent the back face 30 for rotation about a corresponding laterally extending wheel axis 36.

Figure 10:
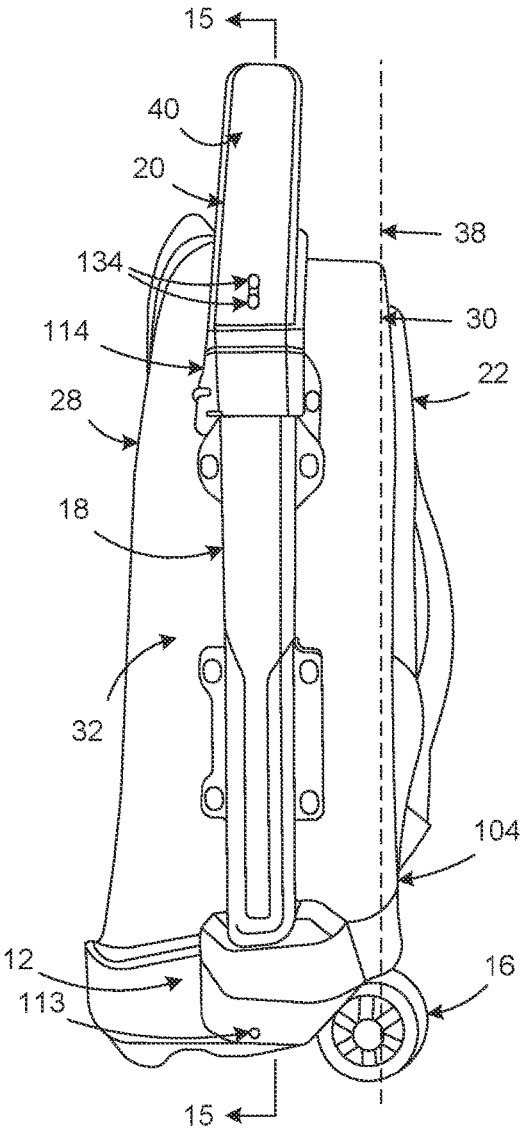
FIG. 10 is a view of the right side of the backpack of FIGS. 1-9, with the telescoping handle in the retracted position, and the front flap in a closed position.

Each of the side frame members 18 is connected to the bottom frame member 12, extending upwardly from the bottom frame member 12 and overlaying an exterior surface 38 of a corresponding one of the sides 32. Furthermore, each of the side frame members 18 are connected to the sides 32 of the bag portion 14. It should be appreciated that this construction provides superior structural support to the bag portion 14 and items that are carried in the bag 14. As best seen in FIG. 10, in the illustrated embodiment, each of the side frame members extends parallel to a plane (illustrated by dashed line 38) defined by the back face 30.

The telescoping handle 20 includes a grip 40 and a pair 42 of laterally spaced grip supports 44 extending downwardly from the grip 40. Each grip support 44 is mounted to a corresponding one of the side frame members 18 to translate relative to the corresponding side frame member 18 between a retracted position, shown in FIGS. 1, 3-6 and 8-10 and an extended position, shown in FIG. 2. Each of the side frame members 18 is located forward of the back face 30 and the wheel axes 36, and, in the illustrated and preferred embodiment, is located slightly off-center between the front and back faces 28 and 30 as best seen in FIG. 1. It should be appreciated that this construction places the handle 20 and the grip 40 in a location that is ergonomically friendly to a user because the placement aligns the handle 20 and the grip 40 closely, or even directly, with the center of gravity of the backpack 10, both in a loaded condition and an unloaded condition of the backpack 10 and an extended and retracted position of the handle 20. This is particularly important because it allows the backpack to easily be carried by the grip 40 when the handle 40 is in the retracted position, thereby eliminating any need for an additional carrying structure, such as, for example, a fixed carry handle that is in addition to a telescoping handle.

Figure 4:
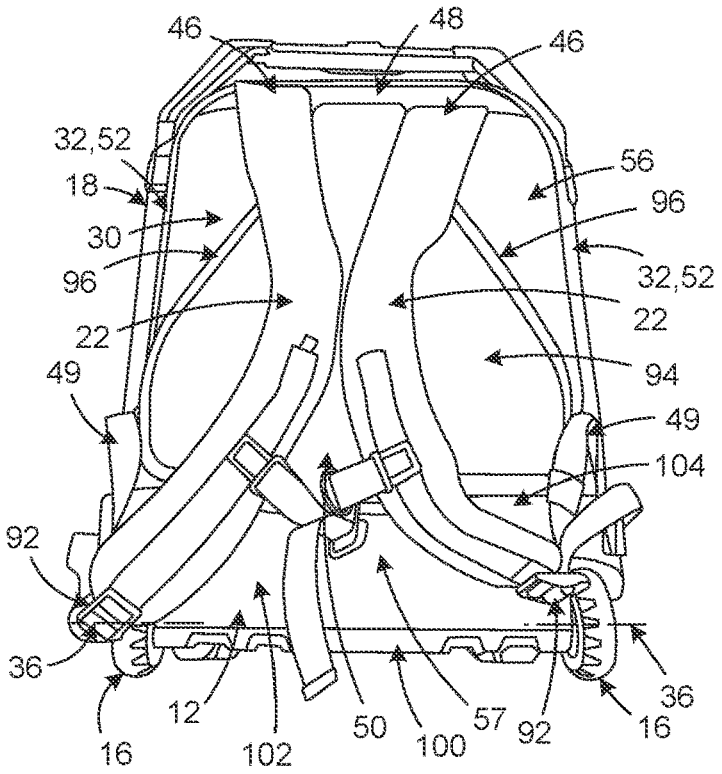
FIG. 4 is a view of the back side and slightly below of the backpack of FIGS. 1-3, with the telescoping handle in the retracted position and a pair of shoulder straps in a ready position.
Figure 13:
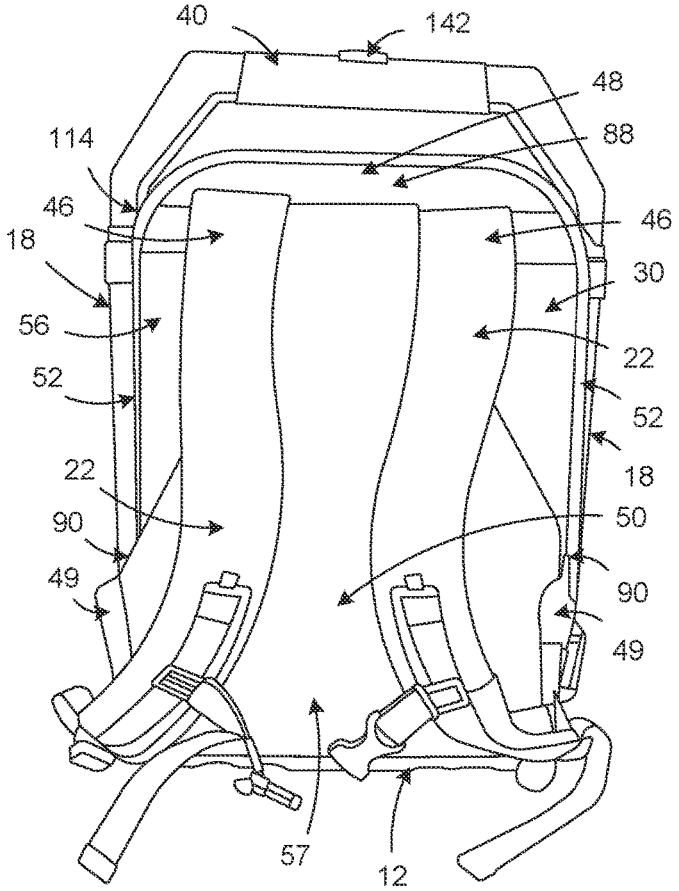
FIG. 13 is a view of the back of the backpack of FIGS. 1-12 with the front flap in a closed position, the telescoping handle in the retracted position, and the shoulder straps in the ready position.

As best seen in FIGS. 4 and 13, each of the shoulder straps 22 overlies the back face 30 and has an upper part 46 connected to an upper region 48 of the backpack 10 and a lower part 49 connected to a lower region 50 of the backpack 10.

Figure 2:
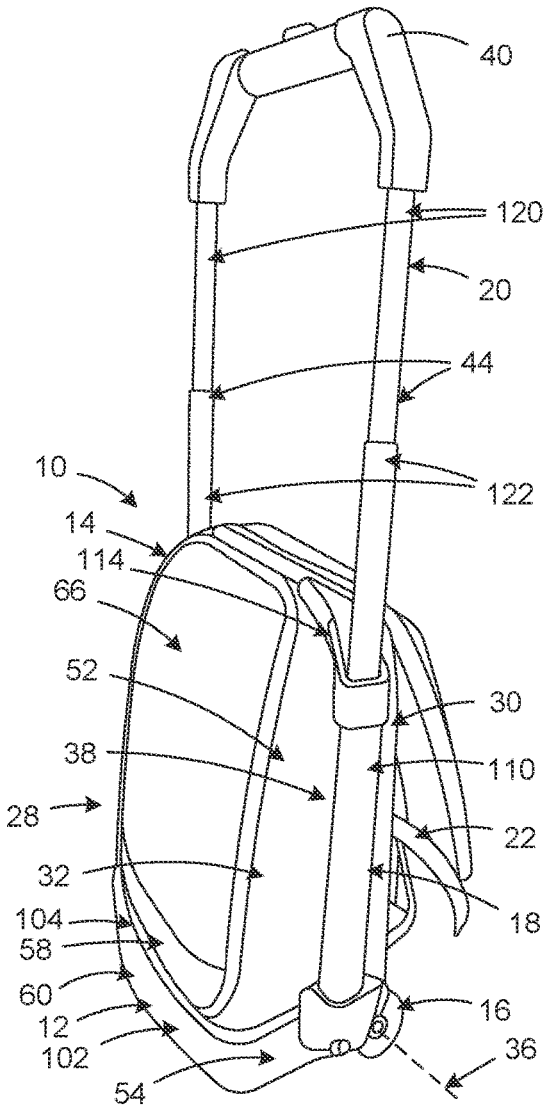
FIG. 2 is a perspective view from above of the front and right side of the backpack of FIG. 1, with the telescoping handle shown in an extended position and with a front flap shown in an open position to expose an interior compartment of the backpack.
Figure 3:
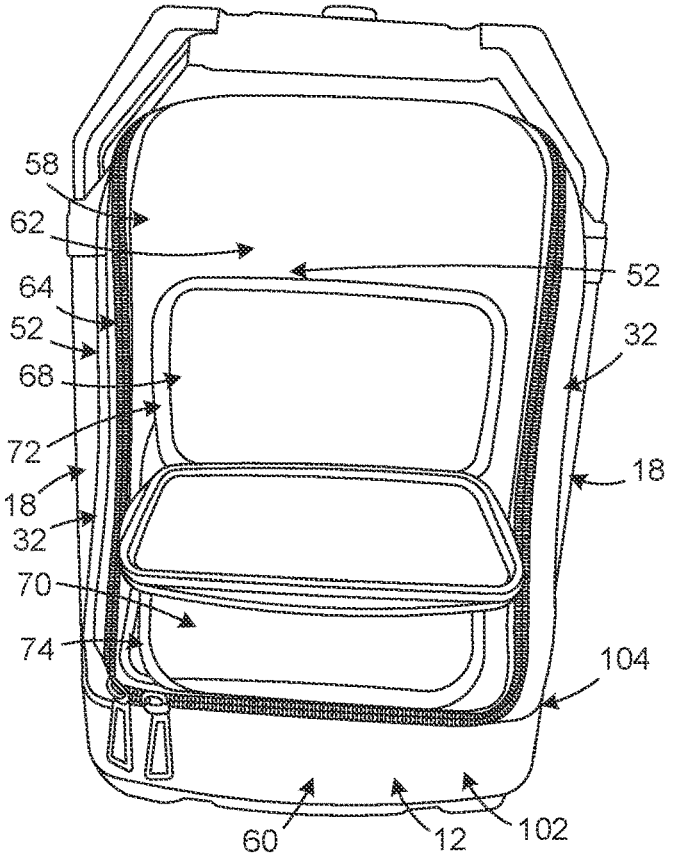
FIG. 3 is a view of the front side of the backpack of FIGS. 1-2, with the telescoping handle in the retracted position and the flap to an external pocket in an open position.

In the illustrated and preferred embodiment and as best seen in FIGS. 1 and 2, each of the sides 32 of the bag portion 14 includes a fabric side panels 52 extending upwardly from a corresponding side portion 54 of the bottom frame member 12. As best seen in FIGS. 4 and 13, the back face 30 includes a fabric back panel 56 extending between the laterally spaced side panels 52 and extending upwardly from a back portion 57 of the bottom frame member 12 to the uppermost part of the bag portion 14. In the illustrated embodiment, the back panel 56 defines the plane 38, as best seen in FIG. 10. As best seen in FIG. 3, the front face 28 includes a fabric front panel 58 extending between the laterally spaced side panels 52 and extending upwardly from a front portion 60 of the bottom frame member 12 to the uppermost part of the bag portion 14.

In the illustrated embodiment and as best seen in FIG. 3, the front panel 58 includes a fabric flap member 62 that is releasably connected to a remainder of the front panel 58 by a zip connector or zipper 64 that extends around three sides (two lateral sides and a bottom side) of the flap member 62 and three corresponding sides of an opening 66 (best seen in FIGS. 2, 6, and 11) that can be selectively closed by the flap member 62 and the zipper 64. As best seen in FIG. 3, in the illustrated embodiment, an exterior side of the flap member 62 includes a pair of pockets 68 and 70 that can be open and closed by respective zippers 72 and 74 that extend around three sides (two lateral and a top side) of each pocket 68 and 70. As best seen in FIG. 12, an interior side of the flap member 62 includes another pair of pockets 76 and 78 that can be open and closed by respective zippers 80 and 82 extending across one side of each pocket 76 and 78.

Figure 6:
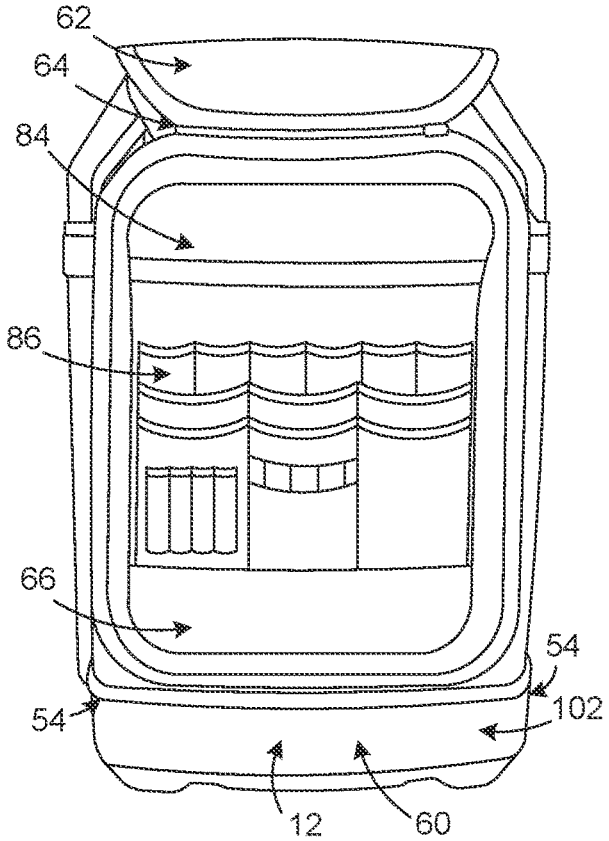
FIG. 6 is a view of the front of the backpack of FIGS. 1-5 with the front flap in an open position, overlying the retracted telescoping handle, to expose the interior compartment of the backpack.
Figure 11:
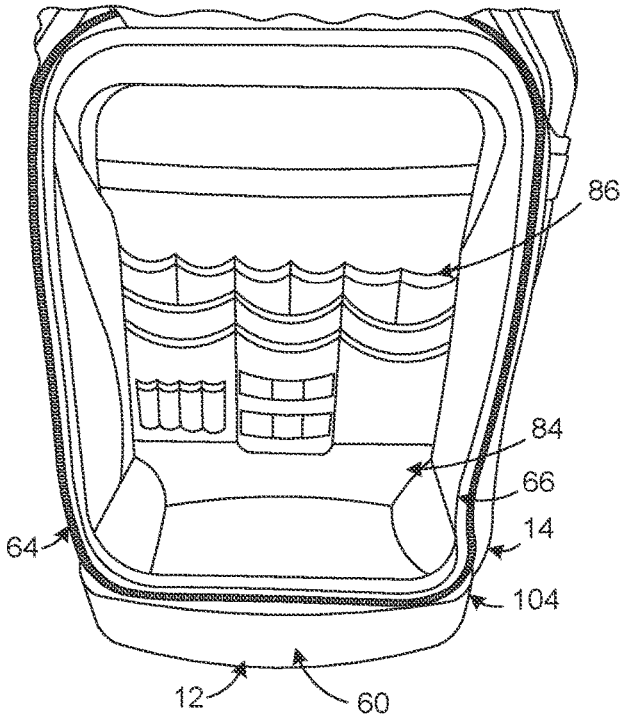
FIG. 11 is a view similar to FIG. 8, but taken from slightly above to provide a different view of the interior compartment of the backpack.
Figure 12:
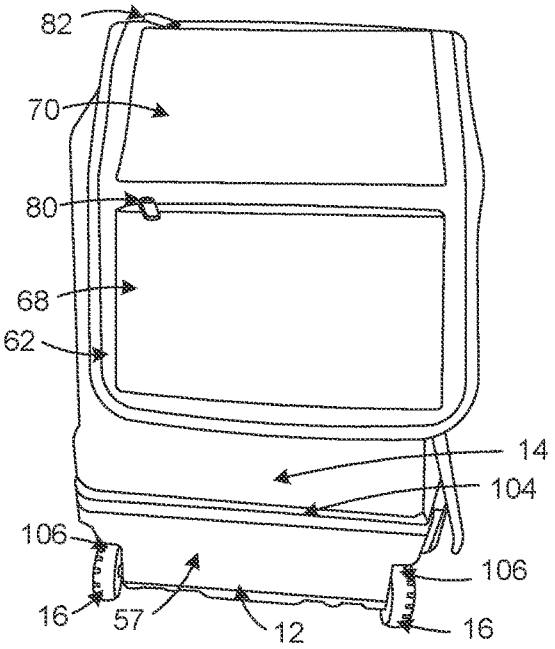
FIG. 12 is a view of the back of the backpack of FIGS. 1-11, with the front flap in the open position, overlying the retracted telescoping handle.

As best seen in FIGS. 6 and 11, the fabric bag portion 14 and bottom frame member 12 enclose a large interior storage compartment 84. The compartment 84 is closed by the flap member 62 and the zipper 64 and can be accessed by opening the flap member 62 and the zipper 64. In the illustrated embodiment, a plurality of open storage pockets 86 are provided in the compartment 84 for stowing individual tools and/or smaller items.

Each of the wheels 16 is mounted by a suitable axle and bearing arrangement (not shown), many of which are known, for rotation about the wheel axis 36. In the illustrated and preferred embodiment, each wheel axis 36 is aligned with the other wheel axis 36 to define one single, laterally extending axis about which the wheels 16 rotate, as best seen in FIG. 5.

Figure 5:
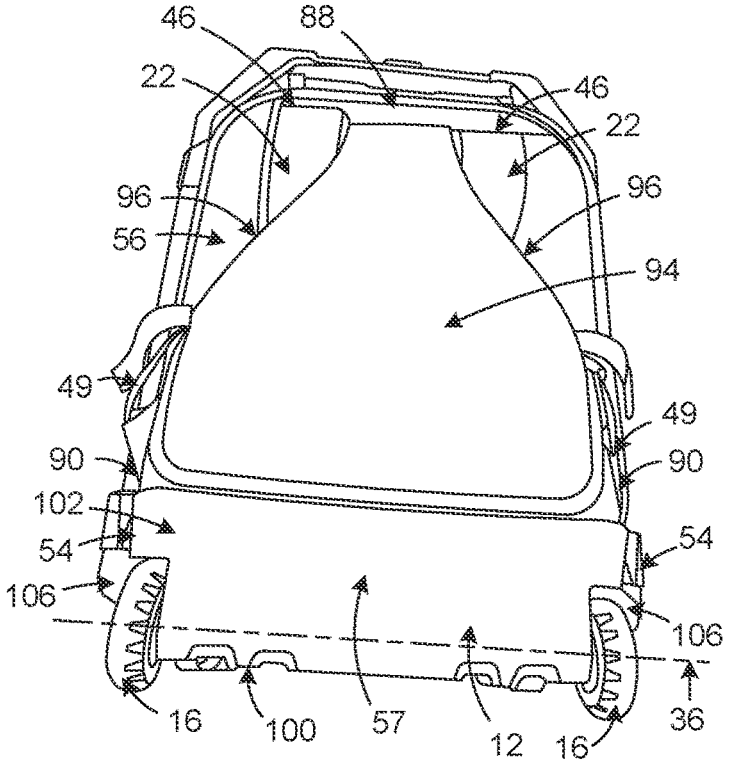
FIG. 5 is a view similar to FIG. 4 but showing the shoulder straps in a stowed position.

In the illustrated embodiment and as best seen in FIGS. 5 and 11, the upper part 46 of each shoulder strap 22 is fixed by any suitable means, many of which are known, including for example stitching, bonding, and/or rivets, to an upper part 88 of the back panel 56. The lower part 49 of each shoulder strap 22 is fixed by any suitable means, again many of which are known, including for example by stitching, rivets, and/or bonding, to an intersection/seam 90 between the back panel 56 and a corresponding one of the side panels 52 located in the lower region 50 of the backpack 10. The lower part 49 of each shoulder strap 22 includes a buckle 92, best seen in FIG. 4, that allows adjustment of the length of the shoulder strap 22 in a well-known fashion. As best seen in FIGS. 4 and 5, a stretchable, mesh, shoulder strap storage pocket 94 is provided on the back panel 56 and includes a pair of side openings 96 that allow the shoulder straps 22 to be tucked into the pocket 94 for storage when the backpack 10 is being transported via the wheels 16.

Figure 7:
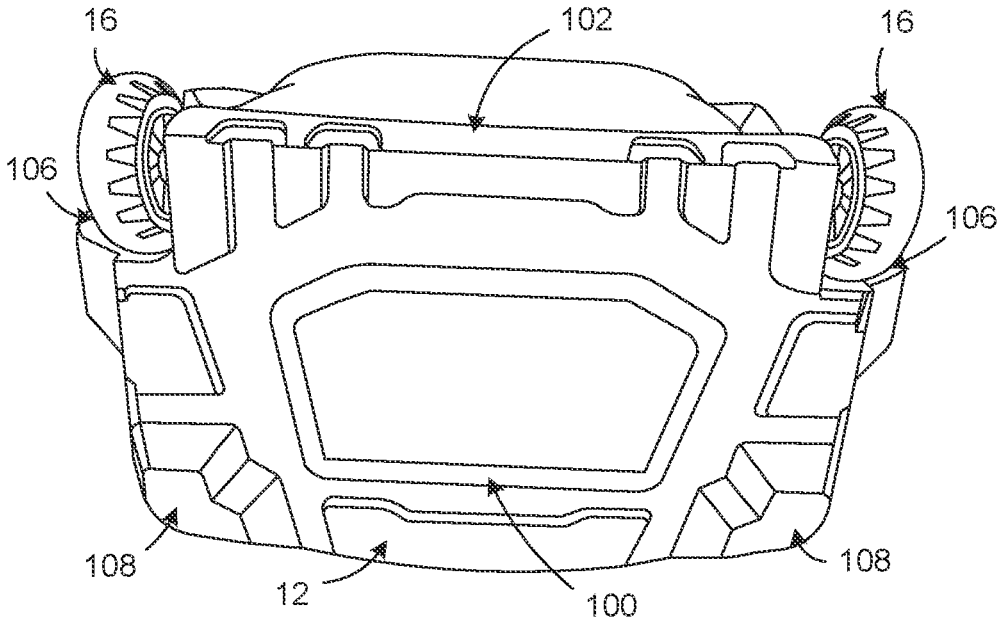
FIG. 7 is a view of the bottom of the backpack of FIGS. 1-6.
Figure 8:
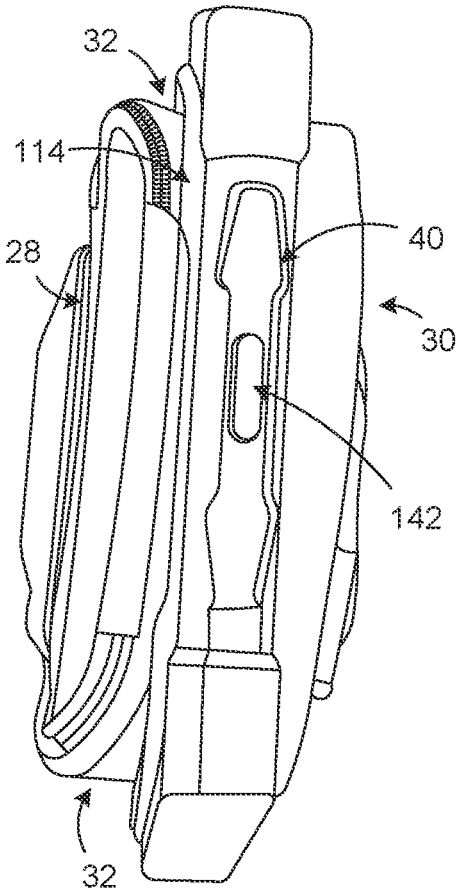
FIG. 8 is a view of the top of the backpack of FIGS. 1-7, with the telescoping handle in the retracted position.
Figure 14:
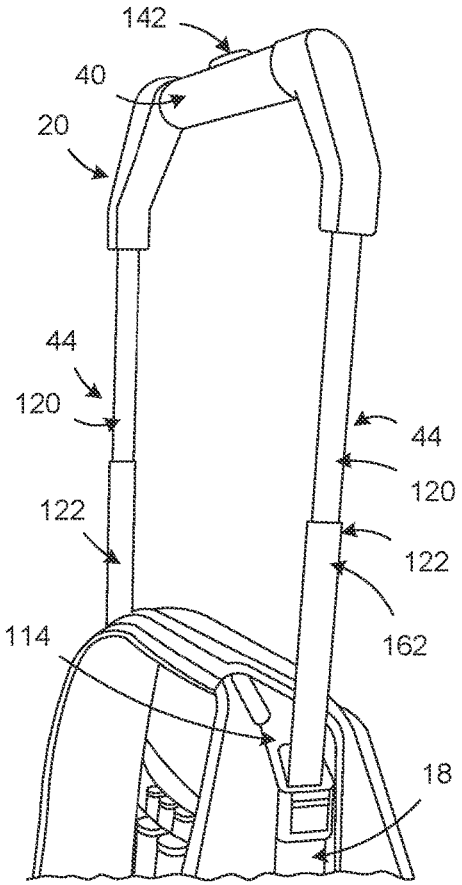
FIG. 14 is a view from the right side of the backpack of FIGS. 1-13 showing an upper portion of the backpack and the telescoping handle in the extended position.

As best seen in FIG. 14, in the illustrated embodiment, the bottom frame member 12 is provided as a one piece, unitary "tub" having a bottom wall 100 and a perimeter wall 102 that extends upwardly from all four sides of the bottom wall 100 to a perimeter rim 104, with the rim 104 and wall 100 and 102 all formed as a single component molded out of a suitable polymer or composite material. As best seen in FIGS. 5 and 7, a pair of wheel receiving recesses 106 are provided in opposite sides of the perimeter wall 102. As best seen in FIG. 7, the bottom wall 100 includes a pair a laterally spaced support feet 108 that extend downwardly from the remainder of the bottom wall 100 to support the backpack 10 in the upright and level position shown in FIGS. 1-3 and 9-14 with the wheels 16 and feet 108 resting on a flat, level surface. In the illustrated embodiment, the side, back, and front panels 52, 56, and 58 are fixed to the rim 104 by any suitable means, including, for example, by stitching, bonding, and/or rivets.

Figure 9:
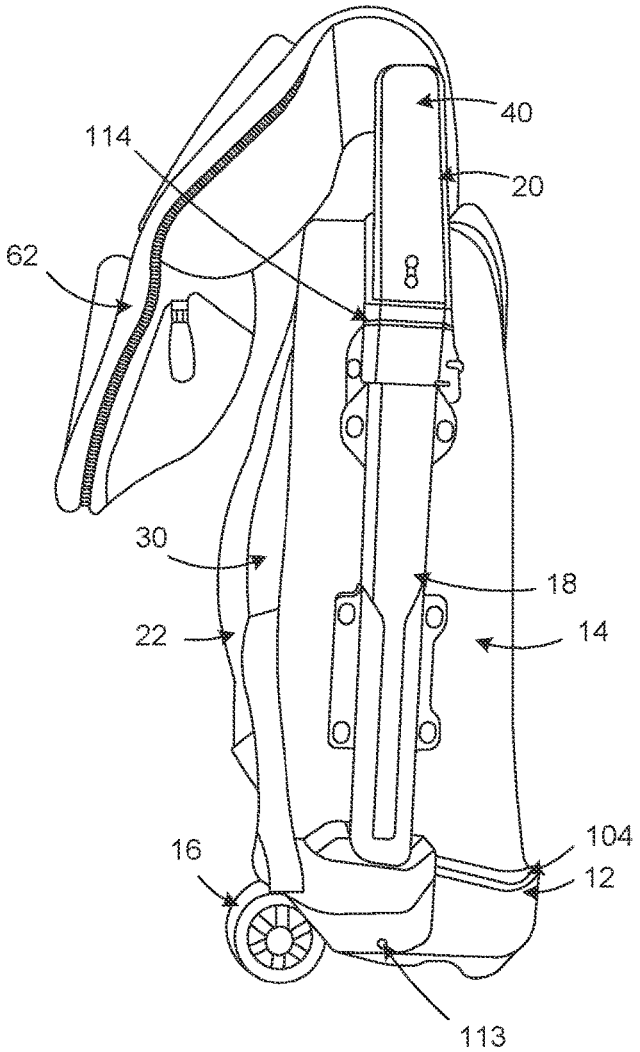
FIG. 9 is a view similar to FIG. 1, but showing the front flap in an open position, overlying the retracted telescoping handle.
Figure 15:
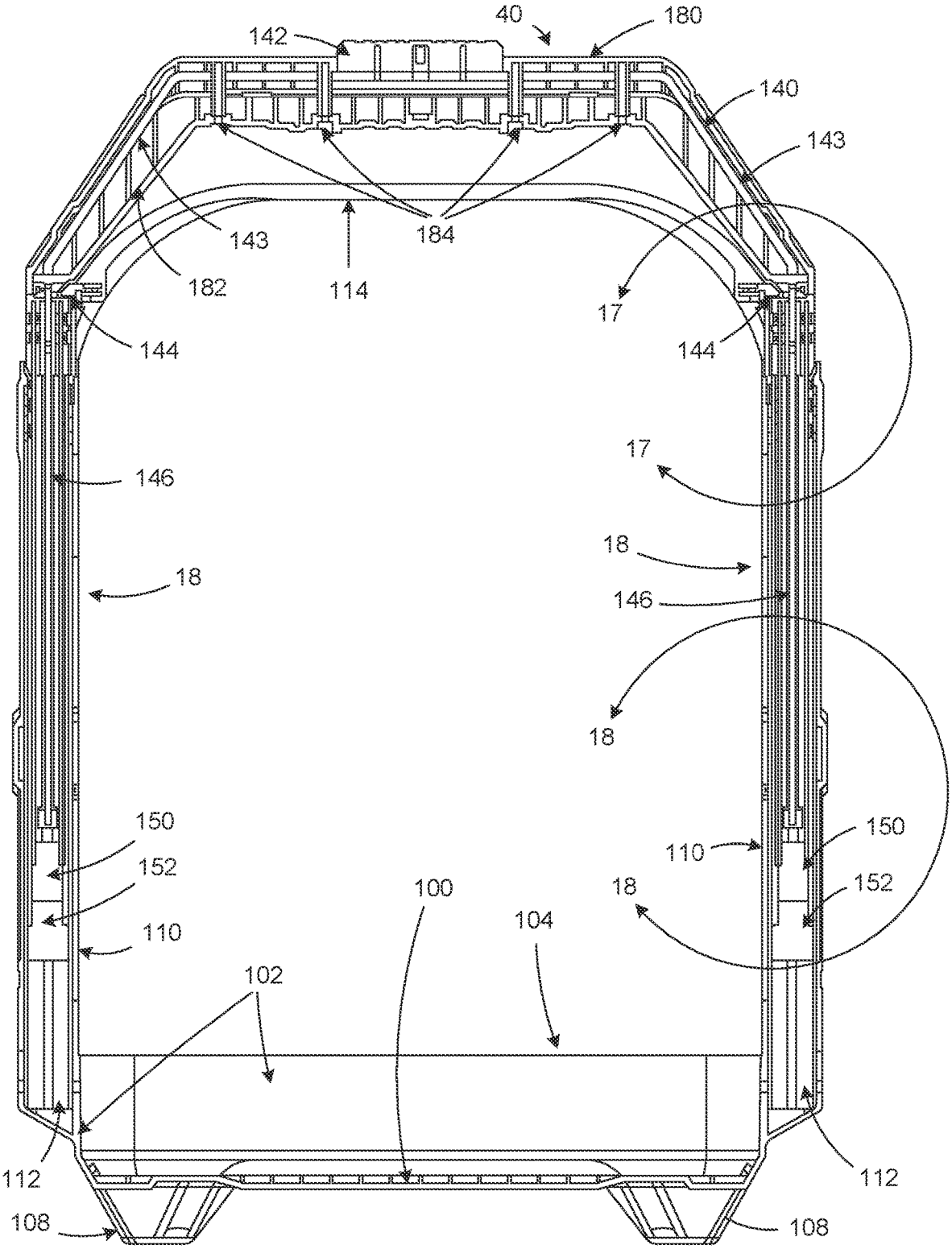
FIG. 15 is a section view taken from line 15-15 in FIG. 10 showing just the structural frame members and the telescoping handle of the backpack of FIGS. 1-14, with the telescoping handle in the retracted position.
Figure 17:
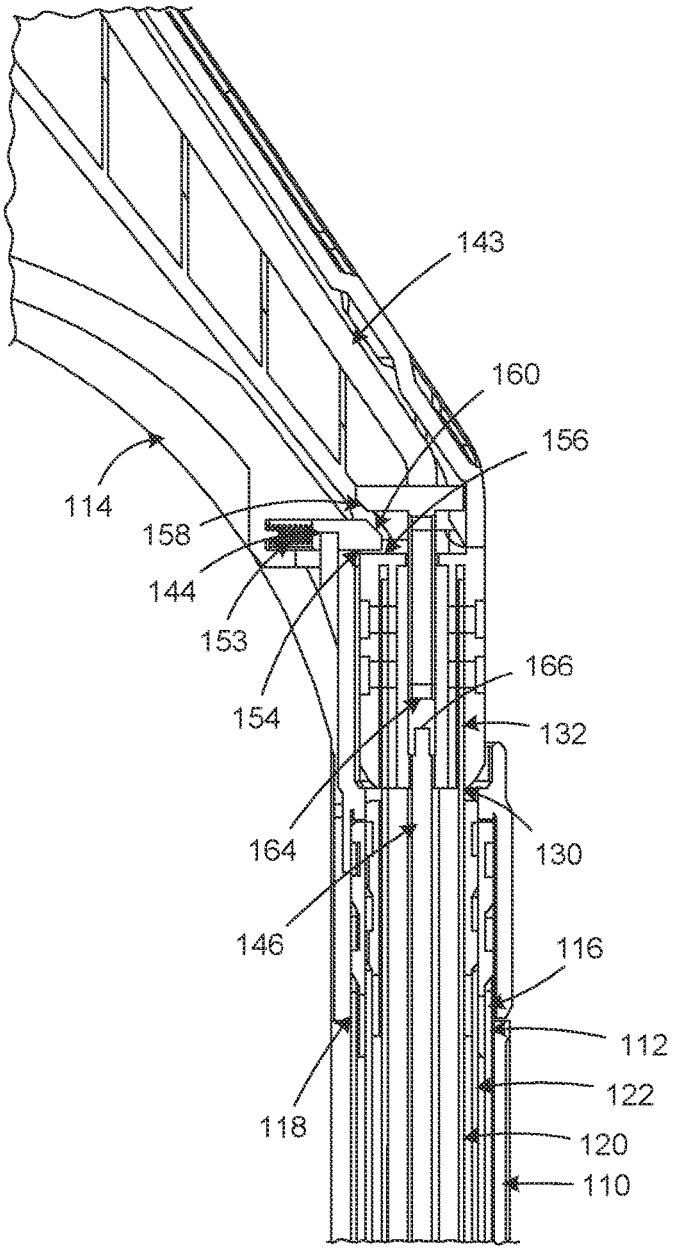
FIG. 17 is an enlarged view of the components encircled by line 17-17 in FIG. 15.
Figure 18:
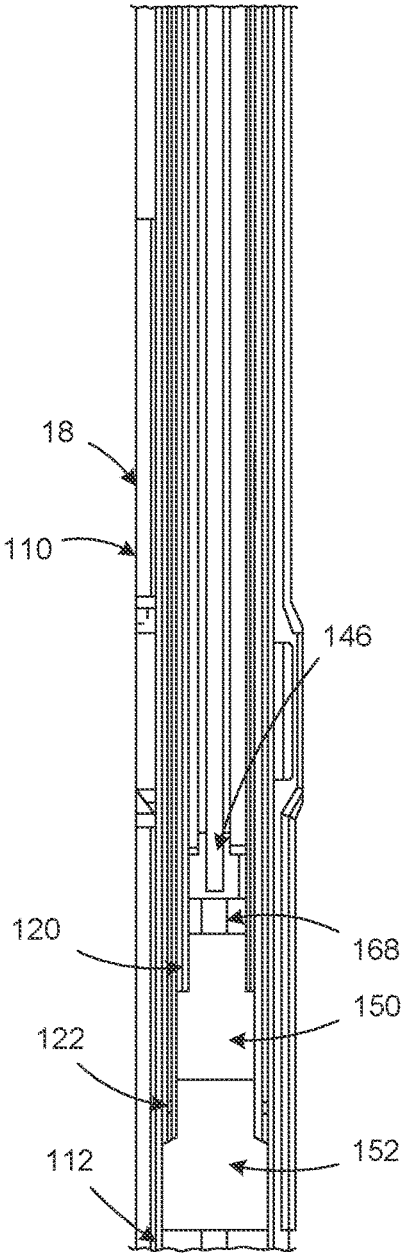
FIG. 18 is an enlarged view of the components encircled by line 18-18 in FIG. 15.

As best seen in FIGS. 15, 17, and 18, in the illustrated embodiment, each of the side frame members 18 includes an outer member 110 and an inner member 112. The outer member 110 is a unitary component molded from a suitable polymer or composite material. The inner member 112 is an elongate, rectangular tube shaped, metallic extrusion. Preferably, both the outer member 110 and the inner member 112 are fixed to the bottom frame member by any suitable means, including for example, by bonding, unitary construction, snap connect features, and fasteners. In the illustrated embodiment and as best seen in FIGS. 9 and 10, the outer and inner members 112 are fixed in a receiving opening of the bottom frame member 12 by suitable metallic, threaded fasteners or rivets 113. Additionally, in the illustrated embodiment, the outer frame members 110 are fixed to the side panels 52 by a plurality of rivets.

As best seen in FIGS. 1, 2, 8-10, and 14-17, the backpack 10 includes an upper frame member 114 in the illustrated and preferred embodiment. The upper frame member 114 overlays the top of the fabric bag portion 14 and extends from one of the side frame members 18, engaging each the side frame members 18 to provide lateral support thereto. In this regard, as best seen in FIG. 17, in the illustrated embodiment, an upper end 116 of the inner member 112 of each side frame member 18 is received in a corresponding opening 118 in the upper frame member 114, with the opening 118 preferably having a conforming shape that is a close fit with the corresponding upper end 116. In the illustrated embodiment, the upper frame member 114 is a unitary component molded from a suitable polymer or composite material.

Figure 16:
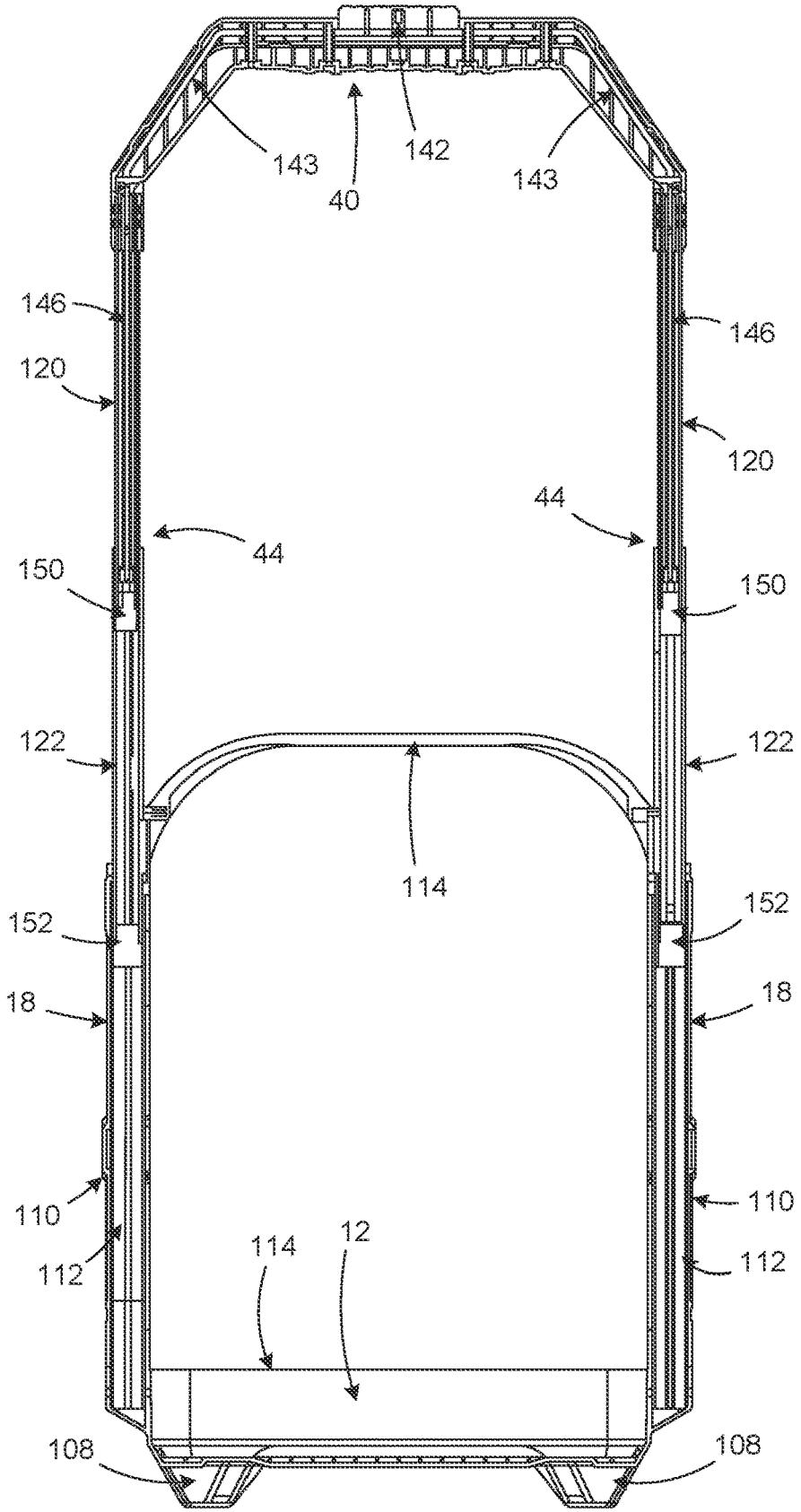
FIG. 16 is a view similar to FIG. 15, but showing the telescoping handle in the extended position.

As best seen in FIG. 16, in the illustrated embodiment, each of the grip supports 44 includes a first telescoping member 120 and a second telescoping member 122. The second telescoping member 122 is slidably mounted in a corresponding one of the inner members 112 and the first telescoping member 120 is slidably mounted in a corresponding one of the second telescoping member 122 so that the members 120 and 122 can translate between the retracted and extended positions. In the illustrated embodiment, both the first and second members 120 and 122 are elongate, rectangular tube shaped, metallic extrusions.

As best seen in FIG. 17, In the illustrated embodiment, the grip 40 includes a pair of laterally spaced, downwardly opening receptacles 130 (only one shown in FIG. 17), with each receptacle 130 receiving an end 132 of a corresponding one of the first telescoping members 120. Each end 132 is fixed in the receptacle by a pair of threaded fasteners 134, as best seen in FIGS. 1 and 10.

A user actuated, releasable locking system 140 is carried within the telescoping handle 20 and includes a user actuated release member 142 that is carried in the grip 40 for movement between a lock position wherein the grip supports are locked in either the retracted or extended positions, and a release position wherein the grip supports are free to translate between the retracted and extended positions. Many such systems are known and can be employed with the handle 20 according to this disclosure. Accordingly, it should be understood that the claims appended hereto are not limited to the specific structures shown for the system 140 in the illustrated embodiments, which will be discussed below for the purpose of providing a complete description of the illustrated embodiment.

Figure 19:
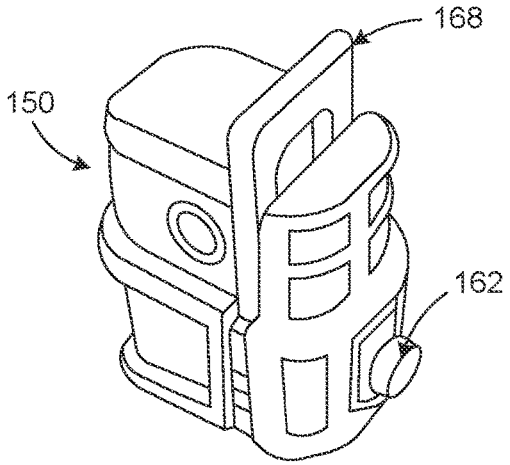
FIG. 19 is an enlarged perspective view from above of a locking mechanism used in the backpack of FIGS. 1-18 and showing a release component in an uppermost position and a latch pin in an engagement position.
Figure 21:
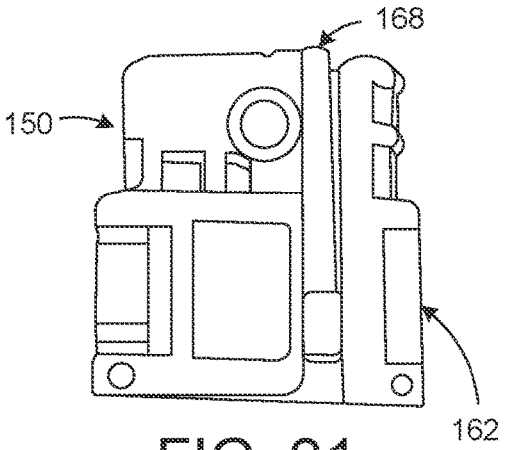
FIG. 21 is a view similar to FIG. 20 but showing the release component in a lowermost position and the latch pin in a release position.
Figure 20:
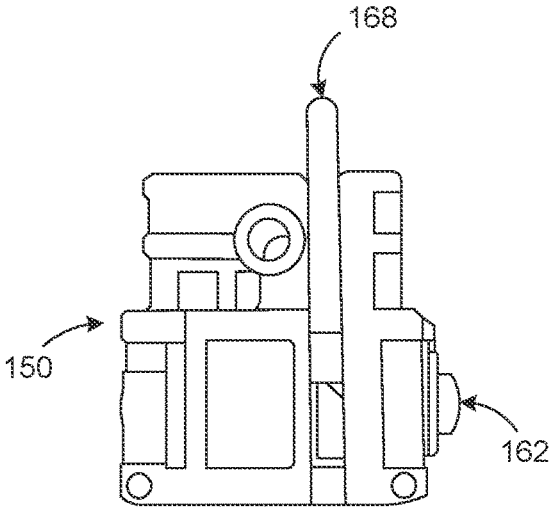
FIG. 20 is a side view of the locking mechanism of FIG. 19 showing the release component in the uppermost position and the latch pin in the engagement position.
Figure 22:
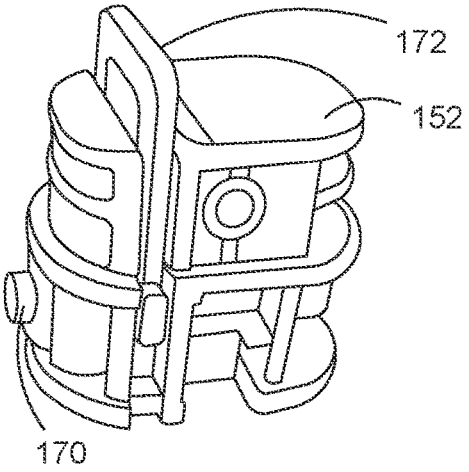
FIG. 22 is a perspective view from the side and above of another locking mechanism used in the backpack of FIGS. 1-18 and showing a release component in an uppermost position and a first latch pin in an engagement position.
Figure 24:
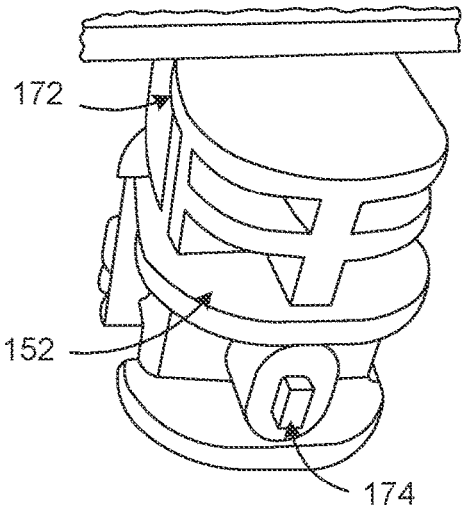
FIG. 24 is a view similar to FIG. 23, but showing the release component in a lowermost position and the second latch pin in an engagement position.
Figure 23:
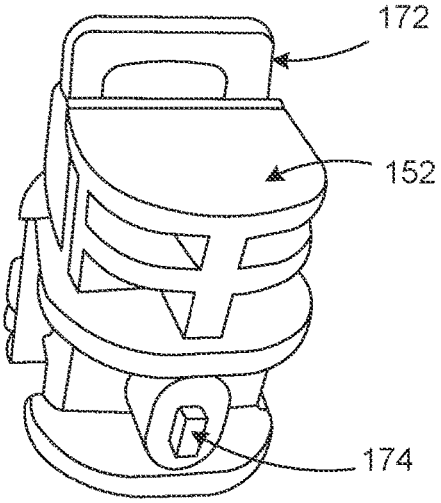
FIG. 23 is a perspective view from the back and above of the locking mechanism of FIG. 22, showing the release component in the uppermost position and a second latch pin in a release position.

In the illustrated embodiment, the system 140 includes the release member 142, a pair of laterally extending release arms 143, a pair of spring biased plunger latches 144, a pair of release rods 146, and two pairs of lower latch mechanisms 150 and 152. The release member 142 is mounted in the grip 40 to translate between the lock and release positions, and the arms 143 are fixed to the release member 142 to translate with the release member 142 between the lock and release positions. In the illustrated embodiment, the release member 142 and the arms 143 are molded as a single, one-piece component, but could be formed from multiple components that are assembled together. Each of the plunger latches 144 is mounted in the upper frame member 114 to translate laterally between a locking position and a released position, with the latch 144 being biased to the locking position by a helical compression spring 153. Each plunger latch 144 includes a downwardly facing stop surface 154 that engages an upwardly facing stop surface 156 on the grip 40 with the latch in the locking position, as best seen in FIG. 17. In the release position, each latch 144 is translated toward the other latch 144 so that the stop surfaces 154 and 156 are disengaged. Each of the arms 143 includes an angled actuating surface 158 that engages an angled actuating surface 160 on a corresponding one of the latches 144 as the release member 142 is translated from the lock position toward the release position to actuate the corresponding latch 144 from the locking position to the released position. Each of the latch mechanisms 150 is fixed in a bottom end of a corresponding one of the telescoping members 120, and each of the latch mechanisms 152 is fixed in a bottom end of a corresponding one of the telescoping members 122. As best seen in FIGS. 19-21, in the illustrated embodiments, each of the latch members 150 includes a latch pin 162 that is spring biased into engagement position where it can be received in receiving openings (not shown) in a corresponding one the telescoping members 122 to lock the members 120 and 122 in either the extended or retracted positions. As best seen in FIG. 17, each of the arms 143 further include a downwardly facing surface 164 that engages an upwardly facing surface 166 on a corresponding one of the release rods 146 as the release member 142 is moved from the lock position toward the release position. This engagement forces each of the release rods 146 to translate downwardly to engage a release component 168 in the latch mechanism 150 that actuates the latch pin 162 to a release position that allows the members 120 and 122 to move relative to each other from the retracted position or the extended position. The latch mechanism 152 includes a latch pin 170 and a release component 172 that are almost identical in form and operation to the latch pin 162 and release component 168 of the latch mechanism 150. In addition, the latch mechanism 152 includes another latch pin 174 that is biased to an engagement position but held in a release position when the release component 172 is in the uppermost position, whereas the latch pin 170 is in an engagement position when the release component 172 is in the uppermost position. Conversely, when the release component 172 is depressed to its lower position shown in FIGS. 15, 18, and 24, the latch pin 170 is moved to its release position and the latch pin 174 is moved to its engagement position. In the extended position, the latch pin 170 is received in an opening (not shown) in the inner member 112 to prevent relative movement between the member 122 and the inner member 112. In the retracted position, the latch pin 174 is received in an opening (not shown) in the inner member 112 to prevent relative movement between the member 122 and the inner member 112. As the member 120 and latch mechanism 150 move from the extended position toward the retracted position, the latch mechanism 150 will engage the release component 172 on the latch mechanism 152 to actuate the latch pin 170 to the release position, thereby allowing the member 122 to move relative to the inner member 112. In the retracted position, the latch pin 174 is in its engagement position, extending into the receiving opening in the inner member 112 because the release component 172 is depressed by the engagement with the latch mechanism 150, as best seen in FIGS. 15 and 18.

While there are many possible constructions, in the illustrated embodiment, the grip 40 is assembled by connecting an upper grip frame 180 to a lower grip frame 182, using suitable threaded fasteners 184, as best seen in FIG. 15. The release member is mounted between the frames 180 and 182 prior to assembly, and the frames 180 and 182 are molded from a suitable polymer in the illustrated and preferred embodiment.

Preferred embodiments of the inventive concepts are described herein, including the best mode known to the inventor(s) for carrying out the inventive concepts. Variations of those preferred embodiments will become apparent to those of ordinary skill in the art upon reading the foregoing description. The inventor(s) expect skilled artisans to employ such variations as appropriate, and the inventor(s) intend that the inventive concepts can be practiced otherwise than as specifically described herein. Accordingly, the inventive concepts disclosed herein include all modifications and equivalents of the subject matter recited in the claims appended hereto as permitted by applicable law. Moreover, any combination of the above-described elements and features in all possible variations thereof is encompassed by the inventive concepts unless otherwise indicated herein or otherwise clearly contradicted by context. Further in this regard, while highly preferred forms of the wheeled backpack 10 are shown in the figures, it should be understood that this disclosure anticipates variations in the specific details of each of the disclosed components and features of the wheeled backpack 10 and that no limitation to a specific form, configuration, or detail is intended unless expressly and specifically recited in an appended claim.

For example, while specific and preferred forms have been shown for the components of the telescoping handle 10, there are many known forms and constructions of telescoping handles which could be employed in the disclosed wheeled backpack 10 without impacting the advantages of the backpack 10. In this regard, there are many known constructions that will allow a telescoping handle to be selectively locked in a retracted position and that could be employed in the backpack 10 without impacting the advantages of the backpack 10. Similarly, there are many known constructions for a telescoping handle 10 that could be employed in the backpack 10 without impacting the advantages of the backpack 10. As another example, while the tub shaped, one-piece bottom frame member 12 shown in the illustrated embodiments is preferred, other shapes and multiple-piece assemblies could be used to form the bottom frame member 12. Similarly, while the two piece (outer member 110 and inner member 112) construction of each of the side frame members is preferred, a one-piece construction could be employed, as could a construction that is formed from more than two pieces. As another example, while the bottom frame member 12 and each of the side frame members 18 are formed as separate pieces, in some embodiments it may be desirable for the bottom frame member 12 and the side frame members 18 to be part of a single, unitary component that is molded as a single piece. As another example, while it is preferred that the bag portion 10 be formed from fabric, one or more of the front face 28, back face 30, sides 32, and/or panels 52, 56, and 58, or portions thereof, could be a rigid or semi rigid structure formed from a suitable metal or molded polymer material. In this regard, while it is preferred that the side frame members 18 be formed as separate components that are attached to the fabric bag portion 14, in some embodiments it may be desirable for the side frame members 18 to be formed as a unitary, one-piece component that is molded as part of rigid or semi-rigid side structures 32 of the bag portion 14. As a further example, while specific mount structure has been discussed for the wheels 16, any suitable mount structure, many of which are known, could be used. As yet another example, while the bag portion 14 has been illustrated with some specific pockets, flaps, and closures, any type and number of pockets, flaps and/or closures could be used on the backpack 10. In another example, while two shoulder straps 22 have been illustrated, in some applications it may be desirable for the backpack 10 to include a single shoulder strap 22. Similarly, while a specific shape and construction has been illustrated for the shoulder straps 22, any suitable shape and construction, many of which are known, could be used for the shoulder straps 22.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. The use of any and all examples, or exemplary language (e.g., "such as") provided herein, is intended merely to better illuminate the inventive concepts disclosed herein and does not pose a limitation on the scope of any invention unless expressly claimed. No language in the specification should be construed as indicating any non-claimed element as essential to the practice of the inventive concepts disclosed herein.

All references, including publications, patent applications, and patents, cited herein are hereby incorporated by reference to the same extent as if each reference were individually and specifically indicated to be incorporated by reference and were set forth in its entirety herein.

What is claimed is:

1. A wheeled backpack comprising:

a bottom frame member;

a pair of laterally spaced side panels extending upwardly from the bottom frame member;

a back panel extending between the side panels and extending upwardly from a back portion of the bottom frame member;

a front panel extending between the side panels and extending upwardly from a front portion of the bottom frame member;

a pair of laterally spaced wheels, each wheel mounted on the back portion of the bottom frame member for rotation about a laterally extending wheel axis;

a pair of side frame members connected to the bottom frame member and extending upwardly from the bottom frame member, each side frame member overlaying an exterior surface of a corresponding one of the side panels and located forward of the back panel and the wheel axes;

a telescoping handle comprising a grip and a pair of laterally spaced grip supports extending downwardly from the grip, each grip support mounted to a corresponding one of the side frame members to translate vertically relative to the corresponding one of the side frame members between a retracted position and an extended position; and at least one shoulder strap overlying the back panel and having an upper part connected to at an upper region of the backpack and a lower part connected to a lower region of the backpack.

2. The wheeled backpack of claim 1 wherein at least some of the panels are fabric panels.

3. The wheeled backpack of claim 2 wherein all the panels are fabric panels.

4. The wheeled backpack of claim 1 wherein the bottom frame member comprises an upper rim and the panels are fixed to the upper rim.

5. The wheeled backpack of claim 1 wherein the upper part of the at least one shoulder strap is fixed to an upper area of the pack panel, and the lower part of the at least one shoulder strap is fixed to a lower area of the back panel.

6. The wheeled backpack of claim 1 wherein the at least one shoulder strap comprises two shoulder straps.

7. The wheeled backpack of claim 1 wherein the pair of side frame members are fixed to the bottom frame member.

8. The wheeled backpack of claim 1 wherein each of the grip supports comprises a first support member slidably received within a second support member.

9. The wheeled backpack of claim 8 wherein each of the second support members is slidably received in the corresponding one of the side frame members.

10. The wheeled backpack of claim 1 wherein the grip supports are releasably locked in the retracted position, and the backpack further comprises a user actuated release member carried in the grip for movement between a lock position wherein the grip supports are locked in the retracted position and a release position wherein the grip supports are free to translate from the retracted position to the extended position.

11. The wheeled backpack of claim 1 wherein the side frame members extend parallel to a plane defined by the back panel.

12. The wheeled backpack of claim 1 further comprising a zip closure releasably attaching a flap portion of the front panel to a remainder of the backpack; and wherein the wheel axes are aligned to define a single laterally extending axis, and the bottom frame member is a one-piece component.

13. A wheeled backpack comprising:

a bottom frame member;

a fabric bag portion connected to the bottom frame member and extending upwardly from the bottom frame member, the bag portion comprising a front face, a back face, and a pair of laterally spaced sides, each side extending between the front and back faces;

a pair of laterally spaced wheels, each wheel mounted on the bottom frame member adjacent the back face for rotation about a laterally extending wheel axis;

a pair of side frame members connected to the bottom frame member and extending upwardly from the bottom frame member, each side frame member overlaying an exterior surface of a corresponding one of the sides and located forward of the back face and the wheel axes;

a telescoping handle comprising a grip and a pair of laterally spaced grip supports extending downwardly from the grip, each grip support mounted to a corresponding one of the side frame members to translate vertically relative to the corresponding one of the side frame members between a retracted position and an extended position; and at least one shoulder strap overlying the back face and having an upper part connected to an upper region of the backpack and a lower part connected to a lower region of the backpack.

14. The wheeled backpack of claim 13 wherein the bottom frame member comprises an upper rim and the fabric bag portion is fixed to the upper rim.

15. The wheeled backpack of claim 13 wherein the upper part of the at least one shoulder strap is fixed to an upper area of the fabric bag portion, and the lower part of the at least one shoulder strap is fixed to a lower area of the fabric bag portion.

16. The wheeled backpack of claim 13 wherein the at least one shoulder strap comprises two shoulder straps.

17. The wheeled backpack of claim 13 wherein the pair of side frame members are fixed to the bottom frame member.

18. The wheeled backpack of claim 13 wherein each of the grip supports comprises a first support member slidably received within a second support member.

19. The wheeled backpack of claim 18 wherein each of the second support members is slidably received in the corresponding one of the side frame members.

20. The wheeled backpack of claim 13 wherein the grip supports are releasably locked in the retracted position and the backpack further comprises a user actuated release member carried in the grip for movement between a lock position wherein the grip supports are locked in the retracted position and a release position wherein the grip supports are free to translated from the retracted position to the extended position.

* * * * *